United States Patent [19]

Gebelius

[11] 4,018,546

[45] Apr. 19, 1977

[54] PUMP DEVICE FOR FLOW RATE CONTROL OF LIQUID IN A PIPING SYSTEM

[76] Inventor: Sven Runo Vilhelm Gebelius, Fridhemsgatan 27, Stockholm, Sweden, S-11240

[22] Filed: Nov. 21, 1974

[21] Appl. No.: 525,980

[30] Foreign Application Priority Data

Dec. 28, 1973 Sweden ..... 7317505

[52] U.S. Cl. ..... 417/313; 137/318

[51] Int. Cl.[2] ..... F04B 21/00

[58] Field of Search ..... 137/318, 320, 321, 322, 137/323; 417/252, 360, 313; 222/85, 86

[56] References Cited

UNITED STATES PATENTS 1,944,648 1/1934 Saussard ..... 417/252

*Primary Examiner*—Martin P. Schwadron
*Assistant Examiner*—G. L. Walton
*Attorney, Agent, or Firm*—Holman & Stern

[57] ABSTRACT

A pump device for flow rate control of liquid in a piping system in which the pump housing sealing engages a pipe of the system, the housing having an axial channel extending parallel to the pipe and communicating at its ends with the pipe via holes in the pipe, a guide member adjacent the upstream hole for guiding a portion of the flow into the pipe, and the rotatable part of a power driven pump mounted on the housing being located in the axial channel for pumping the fluid therein into the pipe through the downstream hole thereby accelerating the liquid flow through the pipe.

6 Claims, 2 Drawing Figures

12
13'
20'
10'
14
17
20
19
10'
13
16'
II
13'
18'
17'
15
15'
14
18
10
16
11'
11
13'
12
II 12
10'
20
19'
20'
13'
17'
16'
14
18'
15
10
18
16
17
13
19

PUMP DEVICE FOR FLOW RATE CONTROL OF LIQUID IN A PIPING SYSTEM

The present invention relates to a pump device for flow rate control of liquid in a piping system.

PRIOR ART

Pump devices for the above purpose are previously known, but it is extremely difficult to attach the known pump devices at suitable positions in a piping system, particularly in piping systems filled with liquid, since the piping system must first be emptied of all liquid. It is often necessary to arrange additional pump devices in a piping system already in use, in order to increase the rate of flow for the liquid and particularly in cases of large scale piping systems, this involves interruptions in the use, which can be extremely costly, especially for systems based on continuous operation.

A demand for a pump device, which can speedily be attached at a suitable position in a piping system filled with liquid, has been known for a long time, since interruptions in the use thereby could be avoided.

SUMMARY OF THE INVENTION

A pump device according to the present invention meets this demand completely, particularly since the pump device can be attached at any desired position in a piping system filled with liquid and under use. The pump device, according to the present invention, comprises a pump housing, in which a pump unit is arranged to be driven rotatably, thus controlling the liquid rate of flow in the piping system, said pump device being mainly characterized in, that the pump housing comprises two pump parts arranged to engage and take up a sealing relationship with a pipe, the two parts being attachable to each other to form a unit, which is arranged with a flow channel extending in parallel relationship to the length axis of the pipe, the channel being connected to the active pump part of the pump unit, the pump housing being arranged with two hole piercing members acting towards the pipe, which are arranged to provide holes through the wall of the pipe when under the influence of power, adjacent to the end portions of the flow channel, thus bringing a part of the liquid in the pipe to flow into one end portion of the flow channel and flow back into the pipe at the other end portion of the flow channel.

The pump device is further characterized in, that the hole piercing members are arranged at the two end portions of the flow channel, and that a peripheral part of the active pump part in the pump unit is arranged at the center portion of the flow channel, and that the hole piercing members are removable from the pipe by means of spring members, when said pipe has been pierced.

An embodiment of the pump device according to the present invention will be further described below, reference being made to the accompanying drawing.

DETAILED DESCRIPTION OF A PREFERRED EMBODIMENT

Figure 1:
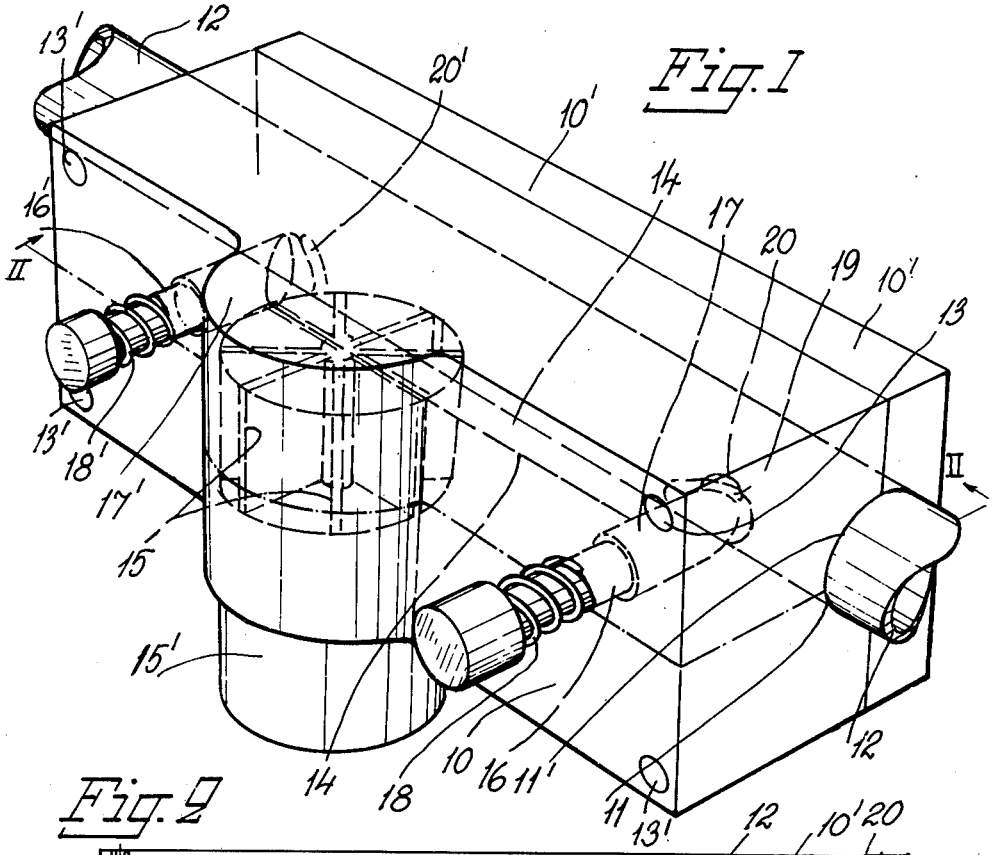
FIG. 1 is a perspective view of the pump device, shown at an inclined angle from above, with the device being attached to a pipe, and the main elements of the pump device being shown in broken lines.

Reference numeral 10 indicates a first longitudinally extending part and 10' a second longitudinally extending part of the pump housing with the housing parts 10, 10' being arranged with two longitudinally extending half circular grooves 11 and 11', respectively. The grooves 11, 11' are arranged to sealingly engage a pipe 12 in the piping system, when the pump housing parts 10, 10' are attached to each other by screws or the like 13, 13'. In the pump housing part 10, a groove 14 is provided to form a channel for liquid extending along the pipe 12. The outer portions of wings or vanes 15 or a turbine of a motor driven pump unit 15' are arranged to extend into the center portion of the channel 14 and to rotate in such portion. The pump unit 15' is attached to the center portion of the pump housing part 10.

At each side of the pump unit 15', towards the pipe 12 and the respective end portion of the channel 14, guiding channels 16, 16' are arranged, with the channels 16, 16' extending normal to the channel 14. In the guiding channels 16, 16', hole piercing members 17, 17', respectively are movably arranged acting towards the pipe 12, and pressure acting helical springs 18, 18' partly surround the members 17, 17'. The members 17, 17' extend, with their free end portions, from the outer surface of the pump housing and, when under influence of power, e.g. by means of a hammer, bolt impact gun or similar means, the hole piercing means 17, 17' are rapidly moved in a direction towards the pipe 12 piercing holes or ports 19, 19' through the pipe 12, the holes or ports 19, 19' communicate with the respective end portions of the liquid channel 14, whereby the liquid channel 14 is flow-connected to the pipe 12. At each hole 19, 19' is arranged a guiding member 20, 20' of the wall material of the pipe 12, with the guiding members 20, 20' serving to guide the flow of liquid from the pipe 12 into the liquid channel 14 and, after being influenced by the wings 15 of the pump unit 15' to guide the liquid back out into the pipe 12.

The pump unit 15', which is preferably driven by an electrical motor, can be operated to rotate the wings 15 in either of the two directions of rotation, depending on the desired flow direction for the liquid in the pipe 12.

If an adjustable liquid flow rate through the liquid channel 14 is desired, the hole piercing members 17, 17' can be arranged adjustably between fixed positions of axial movement, whereby the inside end portions of the hole piercing members 17, 17' serve as valve members acting against the edge portions of the holes 19, 19' in combination with the guiding members 20, 20'.

In this case, the hole piercing members 17, 17' can be arranged at the free end portions, protruding from the outside surface of the pump housing part 10, with control wheels having spaced marks indicating the degree of rotation.

The necessary power influence for the hole piercing members 17, 17' can also be arranged by means of explosive cartridges, activated by means of a firing pin. In this case, the outer portions of the guiding channels 16, 16' are arranged with threaded seats for the cartridges, in which the firing pins are arranged to move when influenced from the outer surface of the pump housing part 10. The gas pressure created when the cartridges are exploded, rapidly moves the hole piercing members 17, 17' towards the pipe 12, thus forming the necessary holes 19, 19' in the pipe 12. Return springs can be arranged in the guiding channels 16, 16', in order to facilitate an automatic return movement of the hole piercing members 17, 17' from the pipe 12 and the liquid channel 14, thus making the channel free for liquid flow from and to the pipe 12.

Figure 2:
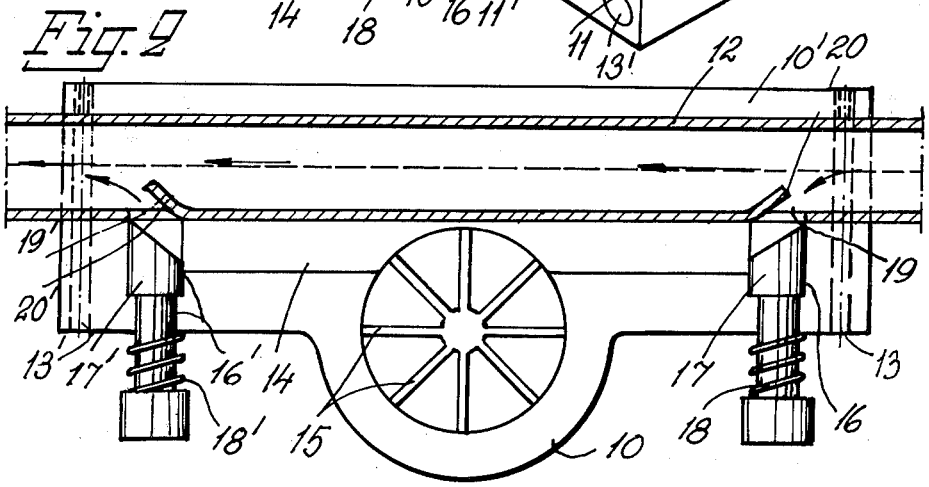
FIG. 2 is a view taken along line II—II in FIG. 1, the view looking in the direction of the arrows.

It should be pointed out that only part of the liquid from pipe 12 enters the port 19 guided by the member 20 as shown in FIG. 2 provided the pump 15' is energized, and the liquid is pumped via the port 19' and guided by the guide member 20' in the direction of flow in the pipe 12. The liquid at the port 19' creates a suction effect on the flow in pipe 12, since the flow is guided in the flow direction of the pipe 12 by the member 20'. If the pump 15' is de-energized, no flow increasing effect is accomplished, but the liquid in the pipe 12 is, in no way, restricted to flow by the de-energization.

The main feature of the pump device according to the present invention is, that the same can be attached at any desired position to a piping system in use, thus completely avoiding any interruptions in the use of the piping system, which has been impossible when the previously known types of pump devices for the same purpose.

The pump device according to the invention can, of course, be modified in a number of ways different from what has been described above and shown in the drawing, and the scope of invention is in no way limited to the embodiment shown and described. The scope of the invention is shown in the accompanying claims.

I claim:

1. A pump device for a flow rate control of liquid in a piping system comprising a pump housing, the pump housing having means sealingly engaging a pipe of the piping system so that the pipe extends axially of the housing, a power driven pump unit having a rotatable part, said pump unit being mounted on the housing, the housing being provided with an axial channel having opposite ends, the channel extending parallel to the pipe, the pipe having a hole communicating with each end of the axial channel, a first guide on the pipe adjacent the upstream hole for guiding a portion of the flow into the axial channel, a second guide on the pipe adjacent the downstream hole for guiding the liquid in the axial channel back into the pipe, and the rotatable part of the pump unit being located in the axial channel so that upon activation of the pump unit, the liquid in the axial channel is pumped via the downstream hole into the pipe thereby accelerating the liquid flow through the pipe.

2. A pump device for flow rate control of liquid in a piping system, comprising a pump housing defined by two parts attachable to each other to provide a unit, said unit having means for engaging sealingly a pipe of the piping system so that the pipe extends axially of the unit, a power driven pump unit having a rotatable part, the pump unit being mounted on the housing unit, said housing unit having an axial flow channel with opposite ends, said axial channel being parallel to the pipe extending axially of the housing unit, the housing unit being provided with a displaceable hole piercing member at each end of the axial channel extending normal to the channel and serving to form holes in the pipe when displaced towards the pipe providing communication between the pipe and the ends of the axial channel, a first guide member on the pipe adjacent one hole facing the direction of liquid flow in the pipe at least partially overlying the hole for guiding a portion of the flow into the axial channel, a second guide member on the pipe adjacent the other hole facing in a direction opposite to the first guide member at least partially overlying the other hole for guiding the liquid in the axial channel back into the pipe, and the rotatable part of the pump unit being located in the axial channel so that upon activation of the pump unit, the liquid in the axial channel is pumped via the other hole into the pipe thus accelerating the liquid flow through the pipe.

3. The pump device according to claim 2 in which the rotatable part of the pump unit is located at the center of the axial channel.

4. The pump device according to claim 2 in which spring members operably related to the piercing members and housing unit displace said members away from the pipe when the holes have been formed.

5. The pump device according to claim 2 in which the means sealingly engaging the pipe is defined by a semicircular groove extending axially of each pump housing part.

6. The pump device according to claim 2 in which explosive cartridges are arranged to displace the hole piercing members in a direction towards the pipe, thus piercing the holes in the pipe.

* * * * *